US007962083B2

(12) United States Patent
Takahashi

(10) Patent No.: US 7,962,083 B2
(45) Date of Patent: Jun. 14, 2011

(54) FIXING DEVICE AND IMAGE FORMING APPARATUS

(75) Inventor: Koji Takahashi, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 701 days.

(21) Appl. No.: 12/056,888

(22) Filed: Mar. 27, 2008

(65) Prior Publication Data

US 2008/0240809 A1 Oct. 2, 2008

(30) Foreign Application Priority Data

Mar. 29, 2007 (JP) ..... 2007-089417

(51) Int. Cl.
*G03G 15/20* (2006.01)

(52) U.S. Cl. ..... 399/329; 399/320; 399/328

(58) Field of Classification Search ..... 399/320
See application file for complete search history.

(56) References Cited

U.S. PATENT DOCUMENTS

| | | | | |
|---|---|---|---|---|
| 6,763,205 | B2 | 7/2004 | Izawa et al. | |
| 2003/0118363 | A1 * | 6/2003 | Izawa et al. | 399/69 |
| 2007/0280756 | A1 * | 12/2007 | Matsumoto | 399/329 |

FOREIGN PATENT DOCUMENTS

| | | | |
|---|---|---|---|
| JP | 11-45025 | A | 2/1999 |
| JP | 2000-98789 | A | 4/2000 |
| JP | 2003-140504 | | 5/2003 |
| JP | 2003-186327 | | 7/2003 |
| JP | 2005-003969 | | 1/2005 |
| JP | 2005-300732 | A | 10/2005 |
| JP | 2006-119263 | A | 5/2006 |

OTHER PUBLICATIONS

Notification of Reasons for Refusal in JP 2007-089417 dated Jan. 20, 2009 , and an English Translation thereof.

* cited by examiner

*Primary Examiner* — David M Gray
*Assistant Examiner* — David Bolduc
(74) *Attorney, Agent, or Firm* — Buchanan Ingersoll & Rooney PC

(57) ABSTRACT

A fixing device forms, with use of an endless belt and a fixing roller that are positioned facing each other, a fixing nip by placing the endless belt in contact with the fixing roller while causing a pressing member to press the endless belt from an inner side thereof against the fixing roller, and fixes an unfixed image onto a recording medium when the recording medium passes through the fixing nip. The fixing device includes (i) a sheet member that is provided between the endless belt and the pressing member and thus reduces friction therebetween, (ii) a supporting mechanism that movably supports the sheet member, and (iii) a sheet member moving part that, when a predetermined condition is not satisfied, keeps the sheet member at rest, and when the predetermined condition is satisfied, moves the sheet member in a certain direction by a predetermined amount.

9 Claims, 7 Drawing Sheets

FIXING DEVICE AND IMAGE FORMING APPARATUS

This application is based on application No 2007-89417 filed in Japan, the contents of which are hereby incorporated by reference.

BACKGROUND OF THE INVENTION

[1] Field of the Invention

The present invention relates to a fixing device for fixing unfixed images on a recording medium, and to an image forming apparatus.

[2] Related Art

Image forming apparatuses such as a copier is equipped with a fixing device. One example of the fixing device is a so-called belt nip type fixing device that forms a fixing nip by placing an endless belt in contact with a fixing roller while causing a pressing member to press the endless belt from an inner side thereof against the fixing roller, and then fixes unfixed images (e.g., toner images) formed on a recording medium when the recording medium passes through the fixing nip.

This belt nip type fixing device is composed of (i) a pressing member that presses the endless belt from the inner side thereof against the fixing roller so that an appropriate pressure is applied to the fixing nip, and (ii) a low-friction sheet that is provided between the endless belt and the pressing member. The low-friction sheet is made by coating a surface of its base material with a fluorocarbon resin material or the like. When the low-friction sheet is provided between the pressing member and the endless belt, friction caused by the pressure is small compared to when the pressing member is placed in direct contact with the endless belt.

However, even when the aforementioned low-friction sheet is provided, the pressure applied to form the fixing nip causes the coating (e.g., the fluorocarbon resin material) of the low-friction sheet to wear over time. Under this condition, continuous use of the fixing device will lead to an exposure of the base material of the low-friction sheet, resulting in an increase in the friction and thus causing the drive load of the endless belt to increase. If the rotation of the endless belt becomes unstable due to the increase in the drive load of the endless belt, a difference may arise between the rotation speed of the endless belt and that of the fixing roller. Accordingly, the fixing nip's ability to transport the recording medium decreases, triggering degradation of the image quality such as an image shift.

SUMMARY OF THE INVENTION

One aspect of the present invention is to provide a belt nip type fixing device that can suppress degradation of image quality owing to friction caused by pressure applied to an endless belt, and an image forming apparatus.

The above aim is fulfilled by a fixing device that forms, with use of an endless belt and a fixing roller that are positioned facing each other, a fixing nip by placing the endless belt in contact with the fixing roller while causing a pressing member to press the endless belt from an inner side thereof against the fixing roller, and that fixes an unfixed image onto a recording medium when the recording medium passes through the fixing nip, the fixing device comprising (i) a sheet member that is provided between the endless belt and the pressing member and thus reduces friction therebetween, (ii) a supporting mechanism that movably supports the sheet member, and (iii) a sheet member moving part that, when a predetermined condition is not satisfied, keeps the sheet member at rest, and when the predetermined condition is satisfied, moves the sheet member in a certain direction by a predetermined amount.

The above structure moves the sheet member in accordance with the predetermined condition. In contrast, with conventional technologies, the sheet member has been held in place to the endless belt, resulting in the wear of the sheet member over time, an increase in the friction increasing, and accordingly, the degradation of image quality. Therefore, the above structure can prevent such disadvantages accompanied by conventional technologies.

The above aim is also fulfilled by an image forming apparatus that includes the aforementioned fixing device as a fixing part that fixes an unfixed image that have been formed on a recording medium to be transported.

BRIEF DESCRIPTION OF THE DRAWINGS

These and other objects, advantageous effects and features of the invention will become apparent from the following description thereof taken in conjunction with the accompanying drawings which illustrate specific embodiments of the invention. In the drawings.

DESCRIPTION OF PREFERRED EMBODIMENTS

The following is a preferred embodiment of a fixing device and an image forming apparatus pertaining to the present invention, taking a tandem-type digital color printer (hereinafter, simply "printer") as an example.

Figure 1:
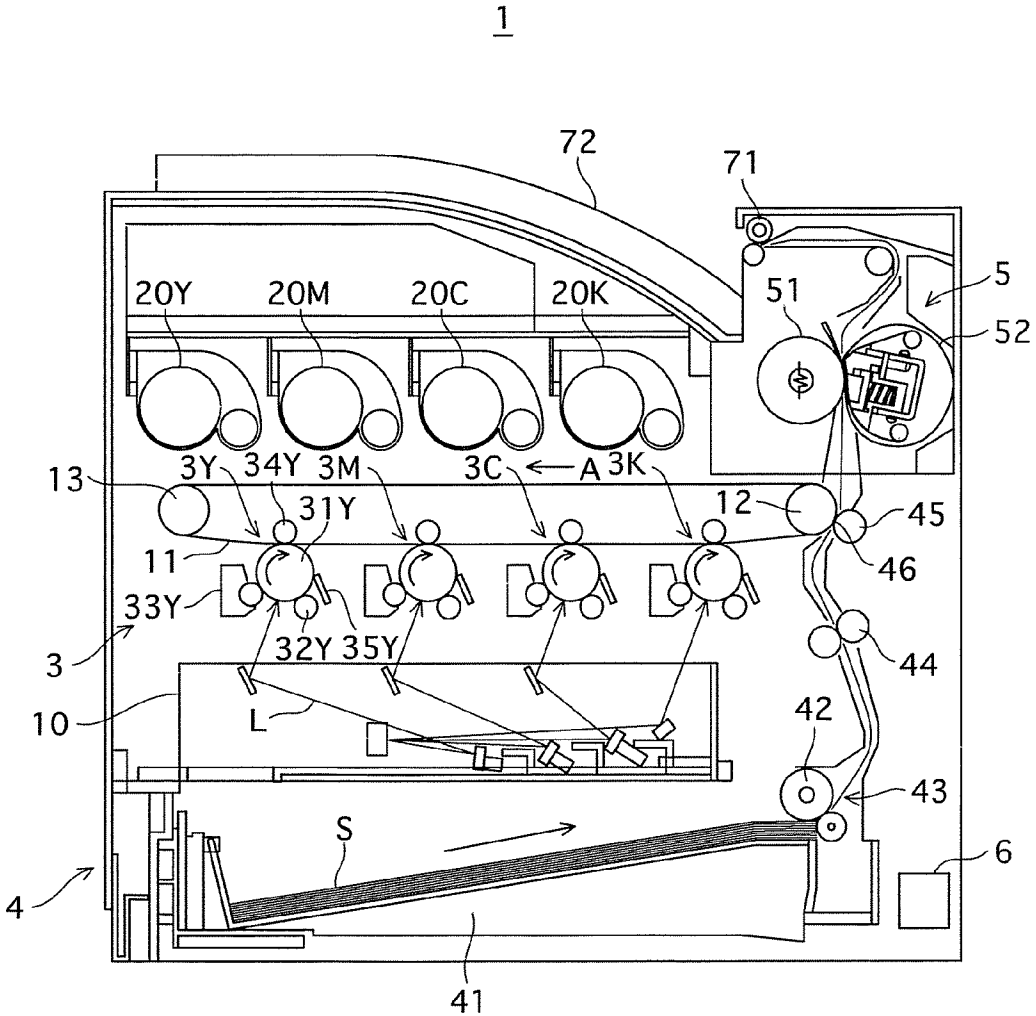
FIG. 1 shows an overall structure of a printer.

FIG. 1 shows an overall structure of a printer 1.

As shown in FIG. 1, the printer 1 includes: an image processing unit 3; a feeder 4; a fixing unit 5; and a controller 6. Upon receiving, from an outside terminal apparatus (not illustrated), an instruction to execute a print job while being connected to a network (e.g., LAN), the printer 1 forms, based on the instruction, color images with use of the colors yellow, magenta, cyan and black. Hereinafter, the colors yellow, magenta, cyan and black that reproduce color images are referred to as Y, M, C and K, respectively. Components of the printer 1 that relate to these colors for reproducing the color images are each assigned a number together with the letter Y, M, C or K.

The image processing unit 3 includes: image forming units 3Y, 3M, 3C and 3K that respectively correspond to the colors Y, M, C and K; a laser unit 10; an intermediate transfer belt 11; toner hoppers 20Y, 20M, 20C and 20K, and so on.

The image forming unit 3Y includes: a photosensitive drum 31Y; a charger 32Y; a developer 33Y; a primary transfer roller 34Y; a cleaner 35Y for cleaning the photosensitive drum 31Y; and so on. The charger 32Y, the developer 33Y, the primary transfer roller 34Y and the cleaner 35Y are disposed around the photosensitive drum 31Y. The image forming unit 3Y forms a Y-colored image on the photosensitive drum 31Y. Other image forming units 3M through 3K have the same structure as the image forming unit 3Y; their numbers are omitted in FIG. 1.

The toner hopper 20Y stores a Y toner as a stock, and provides the Y toner to the developer 33Y as necessary. Similarly, other toner hoppers 20M, 20C and 20K store M, C and K toners as stocks, and provide them to the developers 33M, 33C and 33K respectively as necessary.

The laser unit 10 includes a light-emitting element such as a laser diode, and emits laser beams L that perform exposure scanning of the photosensitive drums 31Y through 31K.

The intermediate transfer belt 11 is endless and stretched and supported by drive rollers 12 and 13, and is rotated in the direction of arrow A.

The feeder 4 includes: a medium feeding cassette 41 that stores a sheet S as the recording medium; a pickup roller 42 that picks up the sheet S stored in the medium feeding cassette 41 one by one, and puts the sheet S onto a sheet path 43 through which the sheet S is transported; a pair of timing rollers 44 that coordinate the timing to send the picked sheet S to a secondary transfer position 46; and a secondary transfer roller 45.

The controller 6 converts an image signal received from the outside terminal apparatus into a digital signal for reproducing images in each color, and generates a drive signal for driving the light-emitting element of the laser unit 10.

The drive signal generated by the controller 6 causes the laser unit 10 to emit the laser beams L and perform the exposure scanning of the photosensitive drums 31Y through 31K on which an electrostatic charge has been applied by the chargers 32Y through 32K. This exposure scanning forms latent electrostatic images on the photosensitive drums 31Y through 31K. The developers 33Y through 33K develop the latent electrostatic images to form, onto the corresponding photosensitive drums 31Y through 31K, toner images of each color. Then the toner images of each color are sequentially transferred onto the intermediate transfer belt 11 by electrostatic forces acting on the primary transfer rollers 34Y through 34K. The toner images of each color are applied to the same area of the intermediate transfer belt 11 at different timings, such that the toner images transferred onto the intermediate transfer belt 11 (primary transfer) are layered on one another. The rotation of the intermediate transfer belt 11 carries the layered toner images of each color applied thereto to the secondary transfer position 46.

In accordance with the rotation timing of the intermediate transfer belt 11, the feeder 4 has sent the sheet S via the pair of timing rollers 44. The rotating intermediate transfer belt 11 and the secondary transfer roller 45 transport the sheet S by holding it therebetween. The layered toner images on the intermediate transfer belt 11 are transferred (secondary transfer) onto the sheet S at one time by electrostatic forces acting on the secondary transfer roller 45.

After passing through the secondary transfer position 46, the sheet S is transported to the fixing unit 5. The fixing unit 5 fixes the toner image (unfixed) onto the sheet S with heat and pressure. The sheet S is then discharged onto a discharge tray 72 by way of a pair of discharge rollers 71.

Figure 2:
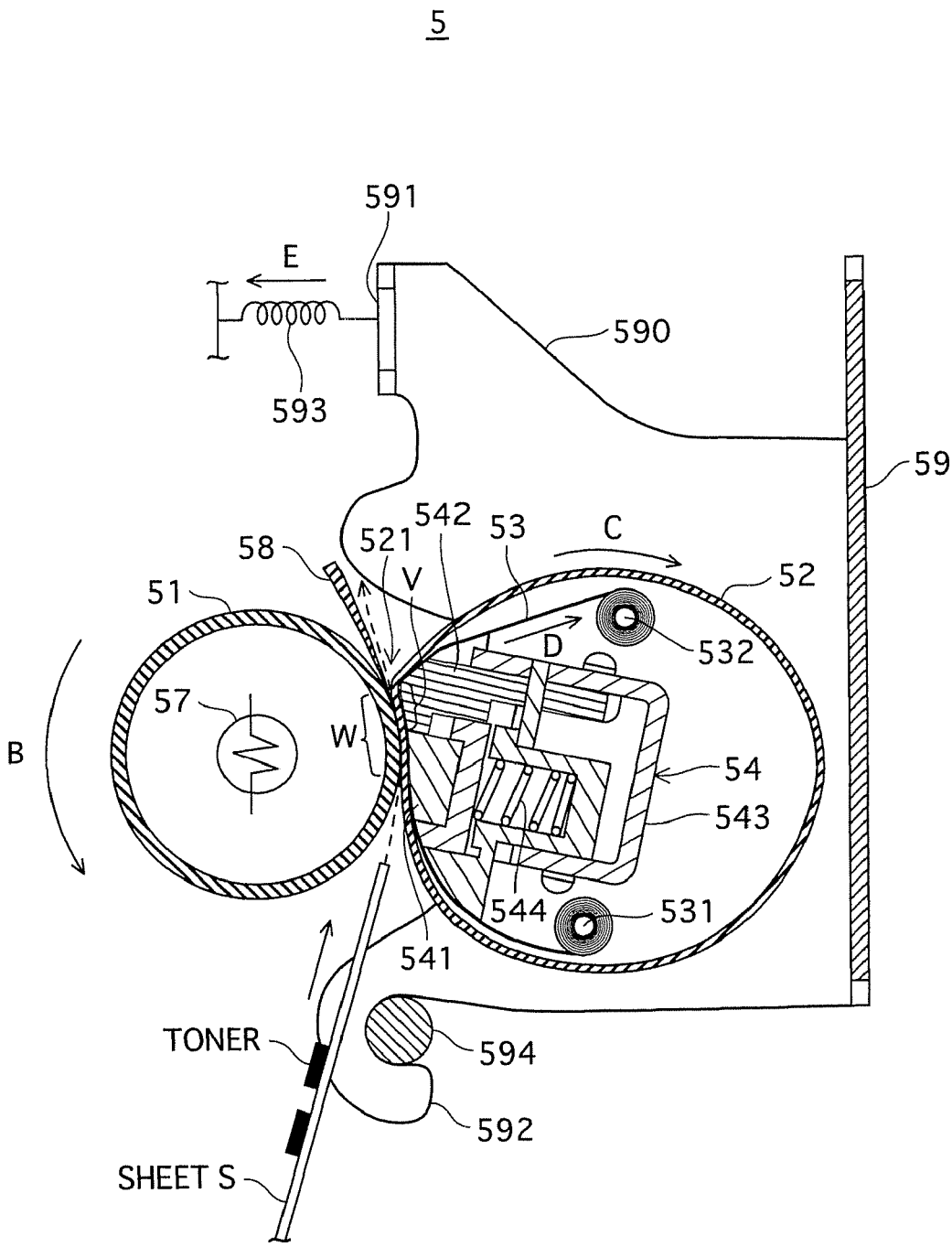
FIG. 2 is a cross-sectional view showing an exemplary structure of a fixing unit provided in the printer.

FIG. 2 is a cross-sectional view showing an exemplary structure of the fixing unit 5.

As shown in FIG. 2, the fixing unit 5 includes: a tubular fixing roller 51 with a heater 57 inserted therethrough; an endless belt 52; a slide sheet 53 having an elongated shape; a pressing member 54, and so on. In the fixing unit 5, the pressing member 54 applies pressure to the endless belt 52 by pressing an inner surface of the endless belt 52 via the slide sheet 53. This places an outer surface of the endless belt 52 in contact with the fixing roller 51 and forms a fixing nip 521. The fixing unit 5 puts the sheet S through the fixing nip 521, melts unfixed toner images with heat, and applies pressure to the sheet S so that the toner images are fixed onto the sheet S. In other words, the fixing unit 5 is a belt nip type fixing device.

The fixing roller 51 is a pipe of iron, such as a carbon steel pipe for machine structural use (STKM 12), or aluminum, and an outer circumferential surface of the pipe has thereon layers of (i) an elastic layer made of silicone rubber and the like and (ii) a releasing layer made of a PFA tube or a PFA coating. The fixing roller 51 is rotatably supported by a support member (not illustrated) provided on a base (not illustrated) of the fixing unit 5. The fixing roller 51 is rotated in the direction of arrow B by a drive force applied by a drive motor (not illustrated). A width of the fixing roller 51 in a width-wise direction is slightly wider than a width of the sheet S. Here, the width-wise direction is perpendicular to a medium transport direction (the direction toward which the sheet S is transported) and corresponds to a main scanning direction. The endless belt 52, the slide sheet 53 and the pressing member 54 have the same width as the fixing roller 51 in the width-wise direction.

An outer surface of the endless belt 52 is a heat-resistant layer that is covered by a releasing layer. The heat-resistant layer is made of a material such as a polyimide resin. The releasing layer is made of a material having a great releasing ability, such as a fluorocarbon resin. It is regarded that the heat-resistant layer and the releasing layer have a thickness of, for example, 80 [μm] and 30 [μm], respectively. The materials and thickness of these layers are not limited to the foregoing description. The endless belt 52 may be single-layered instead of double. One or more different layers may be provided between the heat-resistant layer and the releasing layer.

The endless belt 52 is tubular and rotatably supported by holders 501 and 502 (see FIG. 3) at both ends. By receiving the drive force that rotates the fixing roller 51, the endless belt 52 rotates in the direction of arrow C in synchronization with the rotation of the fixing roller 51. For the purpose of clarifying the structure of the endless belt 52, the holders 501 and 502 are not illustrated in FIG. 2.

The pressing member 54 includes: a soft pad 541 made of a flexible material; a hard pad 542 made of a rigid material; and a support member 543 that supports the soft pad 541 and the hard pad 542.

Both ends of the support member 543 in the width-wise direction are held in place by the holders 501 and 502.

The soft pad 541 is made of, for example, rubber—more specifically, silicone rubber. The hard pad 542 is made of, for example, metal or a heat-resistant resin—more specifically, aluminum.

The soft pad 541 is provided in a place that corresponds to the center of the fixing nip 521 in the medium transport direction. With the resilience of a compression spring 544, the soft pad 541 applies pressure to the endless belt 52 via the slide sheet 53 by pressing the endless belt 52 against the fixing roller 51. Being made out of the soft material, the soft pad 541 can, in the aforementioned place, keep the contact pressure between the fixing roller 51 and the endless belt 52 uniform, and therefore can improve a fixing ability.

Along the sheet path 43, the hard pad 542 is provided downstream of the soft pad 541. A front end of the hard pad 542 has an angle that presses the endless belt 52 such that the endless belt 52 is compressed against the fixing roller 51. This structure makes it easier for the sheet S to, after passing through the fixing nip 521, detach from the endless belt 52. As a result, the sheet S is prevented from getting wrapped around the endless belt 52, and can be transported in a more efficient manner.

The slide sheet 53 is inserted between the endless belt 52 and the pressing member 54 and thus reduces the friction generated by the pressing member 54 applying the pressure to the endless belt 52. The slide sheet 53 is wound on and held by a supply roller 531 and a take-up roller 532. When a given condition (described later) is satisfied, the take-up roller 532 takes up the slide sheet 53 by winding the slide sheet 53 thereon by a predetermined amount in the direction of arrow D.

The slide sheet 53 is made by, but not limited to, coating a heat-resistant glass fabric material with a fluorocarbon resin, and thus has an improved heat resistance, wear resistance, and an ability to slide across the endless belt 52. The slide sheet 53 may be made by joining a fluorocarbon resin sheet and a glass fabric material by pressure.

The slide sheet 53 has a concavo-convex surface that is from the glass fabric material. The concavo-convex surface reduces the areas in which the slide sheet 53 is in touch with the endless belt 52. This results in the slide sheet 53 having a lower friction resistance against the endless belt 52. The aforementioned fluorocarbon resin is made of, for example, PTFE, a mixture of PTFE and PFA, etc.

A frame 59 has, at each end thereof in the width-wise direction, a sidewall 590 coupled thereto. In FIG. 2, only one out of two sidewalls is illustrated. Each of the aforementioned holders 501 and 502 is supported by a respective one of the sidewalls 590.

Each sidewall 590 has a hook 592 at its bottom. The hook 592 is hung on a fixed shaft 594. An upper edge of each sidewall 590 is connected to one end of a tension spring 593. The other end of the tension spring 593 is connected to the base of the fixing unit 5. As the tension spring 593 pulls the frame 59, the frame 59 applies a force in the direction of arrow E as if it tries to rotate around the fixed shaft 594 (fulcrum), and the pressing member 54 presses the fixing roller 51 via the endless belt 52 and the like. The pressure applied by the soft pad 541 is increased by the resilience of the compression spring 544.

Along the sheet path 43, a removal nail 58 is placed downstream of the fixing nip 521. When an edge of the sheet S that has passed through the fixing nip 521 is stuck to an outer circumferential surface of the fixing roller 51, the removal nail 58 forcibly takes the sheet S off the fixing roller 51.

Figure 3:
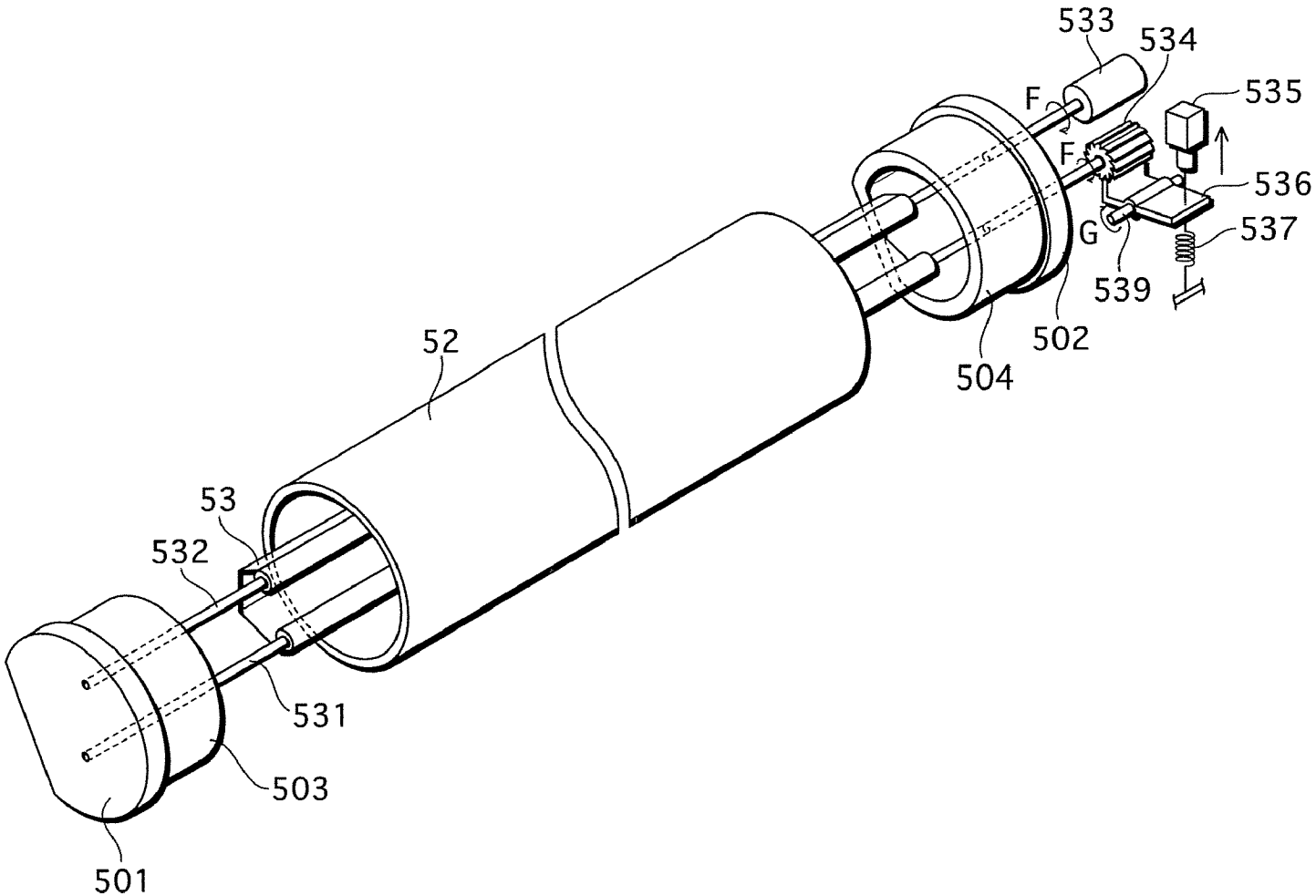
FIG. 3 is an exploded perspective view illustrating a slide sheet take-up mechanism provided in the fixing unit.

FIG. 3 is an exploded perspective view illustrating a slide sheet 53 take-up mechanism. In FIG. 3, components that are unrelated to the following explanation, such as the pressing member 54, are not illustrated. Note that FIG. 3 is an overview of the mechanism. Components shown in FIG. 3 are not illustrated in the actual size.

As shown in FIG. 3, the holders 501 and 502 are flange-like components, each having the shape of a letter D when viewed from the front. The holders 501 and 502 are held by the sidewalls 590 shown in FIG. 2. The endless belt 52 is rotatably fit around small diameter portions 503 and 504.

The take-up roller 532 takes up the slide sheet 53 and is rotatably supported by the holders 501 and 502. One end of the take-up roller 532 penetrates through the holder 502 and is connected to a rotation shaft of a take-up motor 533.

The supply roller 531 supplies the slide sheet 53 and is rotatably supported by the holders 501 and 502. One end of the supply roller 531 penetrates through the holder 502 and is connected to a ratchet wheel 534.

A pawl 536 is arranged below the ratchet wheel 534, and has a shaft 539 that is rotatably supported by supporting members (not illustrated). The pawl 536 is also connected to a tension spring 537 and a release solenoid 535.

In a normal state (when the slide sheet 53 is not being wound), the take-up motor 533 and the release solenoid 535 do not operate. By getting pulled by the tension spring 537, the pawl 536 is drawn in the direction of arrow G and engaged with the ratchet wheel 534. In this state, the motion of the supply roller 531 is stopped—i.e., the rotation of the supply roller 531 is restricted.

On the other hand, while the take-up roller 532 is winding the slide sheet 53, the release solenoid 535 operates. Here, a plunger of the release solenoid 535 exercises its suction force to pull the pawl 536. As the suction force is stronger than the pull force of the tension spring 537, the pawl 536 is attracted in the opposite direction of arrow G and thus freed from being engaged with the ratchet wheel 534. This physical separation of the pawl 536 from the ratchet wheel 534 releases the supply roller 531 from the state of being restricted from rotating.

As the release solenoid 535 operates, the take-up motor 533 operates at the same time. Accordingly, the supply roller 531 and the take-up roller 532 rotate in the direction of arrow F. The rotation of the take-up roller 532 winds the slide sheet 53; the supply roller 531 supplies the slide sheet 53 according to how much of the slide sheet 53 is wound. Note that a mechanism to restrict the rotation of the supply roller 531 is not limited to the one described above; the mechanism may incorporate, for example, a heretofore known torque limiter, electromagnetic brake, etc. It is possible to wind the slide sheet 53 without it getting loose by placing a certain load on the supply roller 531 during the winding.

Figure 4:
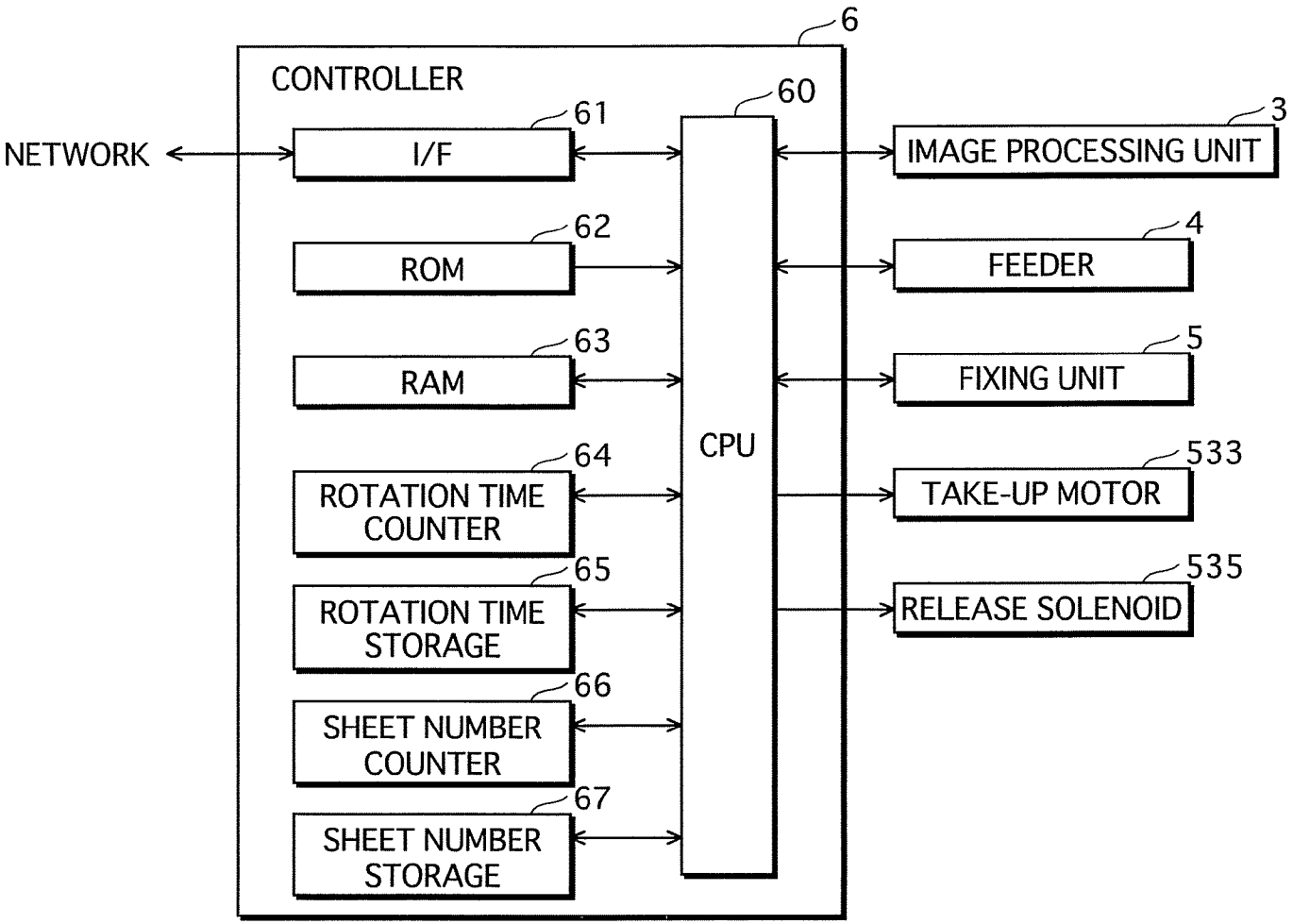
FIG. 4 is a block diagram showing a structure of a controller provided in the printer.

FIG. 4 is a block diagram showing a structure of the controller 6.

As shown in FIG. 4, the controller 6 includes, as major components thereof; a CPU 60; a communication interface (IF) 61; a ROM 62; a RAM 63; a rotation time counter 64; a rotation time storage 65; a sheet number counter 66; and a sheet number storage 67.

The communication IF 61 is an interface for connecting the printer 1 to a network, such as a LAN card.

The rotation time counter 64 measures a rotation time, which is an elapsed time during which the fixing roller 51 in the fixing unit 5 has rotated. The time is measured by a timer that counts, for example, an elapsed time between a start and an end of the driving of the fixing roller 51. Each time the rotation time counter 64 measures an elapsed time, it performs steps of: (i) adding the measured rotation time to an existing rotation time that is stored in the rotation time storage 65 at that time; and (ii) overwriting the existing rotation time with a new value, which is a sum of the measured rotation time and the existing rotation time, as a latest rotation time.

The rotation time storage 65 consists of, for example, a nonvolatile memory, and stores therein information indicating a current total (cumulative) rotation time of the fixing roller 51 up until that point.

Each time one sheet S passes through the fixing unit 5, the sheet number counter 66 performs steps of: (i) incrementing, by one, an existing number of the sheet S that has passed the fixing unit 5, which is stored in the sheet number storage 67; and (ii) overwriting the existing number with a new value, which is the existing number after it was incremented, as a latest sheet number.

The sheet number storage 67 consists of, for example, a nonvolatile memory, and stores therein information indicating a current total (cumulative) number of the sheet S that has passed the fixing unit 5 up until that point.

The CPU 60 reads necessary programs from the ROM 62, and executes a smooth printing operation by, with precise timing, controlling operations of the image processing unit 3, the fixing unit 5, etc. as a whole. The CPU 60 also executes a sheet movement control process, which is a process of moving the slide sheet 53 by winding it. The RAM 63 is used as a work area during the CPU 60's execution of the programs.

Figure 5:
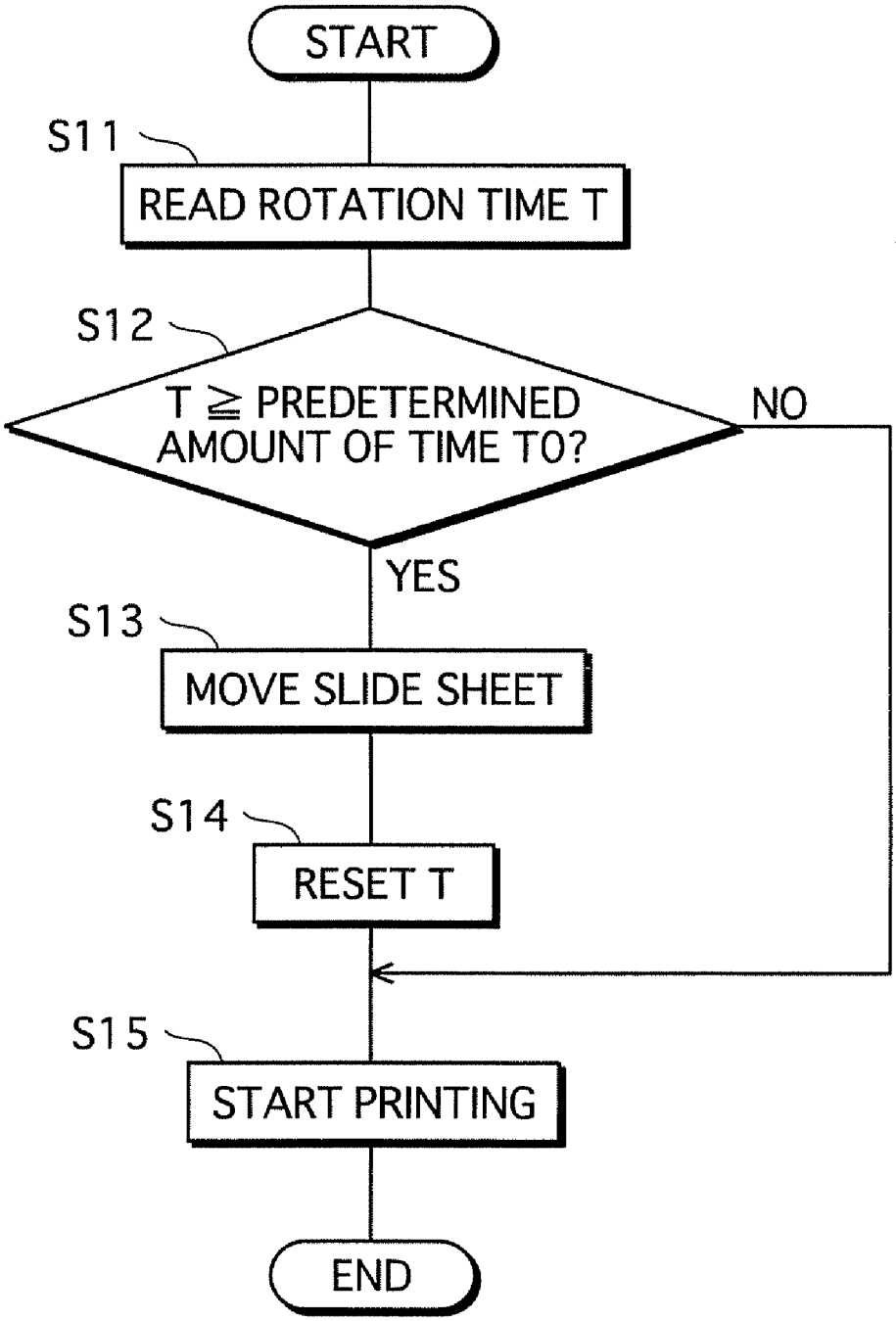
FIG. 5 is a flowchart showing an example of a sheet movement control process that is executed by the controller.

FIG. 5 is a flowchart showing an example of the sheet movement control process. Upon issuing of an instruction to execute a print job, the sheet movement control process is executed before the print job is actually started.

As shown in FIG. 5, the CPU 60 first reads the information indicating the rotation time stored in the rotation time storage 65 (Step S11). The CPU 60 then judges whether or not the read rotation time T is more than or equals to a predetermined amount of time T0 (Step S12). Here, the predetermined amount of time T0 is set such that by the time the rotation time T hits or exceeds the predetermined amount of time T0, the slide sheet 53 is assumed to have been worn to the point where problems such as an image shift can occur. For example, the predetermined amount of time T0 can be approximately 50 [hours] to 70 [hours]. The predetermined amount of time T0 can be obtained in advance based on experiments and the like, and its data is stored in the ROM 62 and the like.

If judging T≧T0 (the "YES" branch of Step S12), the CPU 60 regards that the given condition is satisfied and executes the operation to move the slide sheet 53 (hereinafter, simply "sheet moving operation") (Step S13). More specifically, the CPU 60 runs the take-up motor 533 and the release solenoid 535 for only a predetermined amount of time ts. The predetermined amount of time ts is, for example, the time required to move the slide sheet 53 by a fixing nip length (i.e., a length of the fixing nip 521 in the medium transport direction as indicated by a letter W in FIG. 2—e.g., approximately 5 mm to 6 mm). The predetermined amount of time ts can be obtained in advance from the number of rotations of the take-up motor 533 (per unit time) during its operation.

The sheet moving operation moves the slide sheet 53 only by the fixing nip length so as to position an unworn, new part of the slide sheet 53 between the endless belt 52 and the pressing member 54. This prevents (i) a further increase in friction caused by the progress of the wear of the slide sheet 53 and (ii) the degradation of image quality associated with an unstable operation of the endless belt 52, which is triggered by the increase in the friction. It should be noted that a length of the slide sheet 53 moved by each sheet moving operation is not limited to the fixing nip length. The slide sheet 53 may be moved to any degree as long as it reduces the friction caused by the pressure. For example, the above length may be a length of a part of the slide sheet 53, the part being pressed by the hard pad 542 (indicated by a letter V in FIG. 2). This is because the hard pad 542 applies the most intense pressure to the slide sheet 53 in the above part, which accordingly has a higher wear volume than other parts of the slide sheet 53 that are pressed by the soft pad 541 and the like. An appropriate amount of the slide sheet 53 move by each sheet moving operation is determined based on the experiments and the like, and then stored in the ROM 62 and equivalents.

Preferably, the sheet moving operation is executed while the fixing roller 51 is rotating. As the endless belt 52 and the slide sheet 53 are moved in the same direction behind the fixing nip 521, when the fixing roller 51 and the endless belt 52 rotate, the friction between the endless belt 52 and the slide sheet 53 applies, to the slide sheet 53, a force toward the direction of the rotation of the endless belt 52. Accordingly, a drive torque required to wind the slide sheet 53 can be lowered. That is to say, it is possible to use a small take-up motor 533, and also to reduce power consumption required to operate the take-up motor 533.

Upon finishing the sheet moving operation, the CPU 60 resets the rotation time T (Step S14). More specifically, the CPU 60 rewrites the rotation time stored in the rotation time storage 65 into "0". The CPU 60 then starts a printing operation (Step S15), and ends the sheet movement control process.

If judging T<T0 (the "NO" branch of Step S12), the CPU 60 regards that the given condition is not satisfied and goes on to Step S15. In this case, the CPU 60 does not execute the sheet moving operation, and the slide sheet 53 thereby remains at rest. From this viewpoint, it can be said that when the sheet movement control process is executed, the controller 6, the take-up motor 533, the release solenoid 535, etc. function as a sheet movement controller that moves or stops the slide sheet 53.

As set forth herein, the present embodiment has the following structure: until a given condition is satisfied (until a predetermined amount of time has passed), the slide sheet 53 remains at rest; however, when the given condition is satisfied (when a predetermined amount of time has passed), the slide sheet 53 is moved in one direction only by a predetermined amount. This way, a part of the slide sheet 53 that is sandwiched between the endless belt 52 and the pressing member 54 can be changed. Conventionally, a slide sheet has been fixed in position on an endless belt 52 and thus becomes worn with time, increasing friction therebetween; the increased friction triggers degradation of image quality. The present embodiment can prevent such problems. Furthermore, it has been conventionally required to replace the low-friction sheet every time the degradation of image quality occurs due to the wear of the low-friction sheet. With the present embodiment, there is no need to perform such a replacement—it thus saves users the trouble of doing the same.

The above-described structure judges whether or not to execute the aforementioned sheet moving operation based on the rotation time of the fixing roller 51. This operation, however, is not limited to such; it can be executed each time the slide sheet 53 is assumed to be at an advanced stage of being worn.

The operation can also be executed on the basis of, for example, the sheet number.

Figure 6:
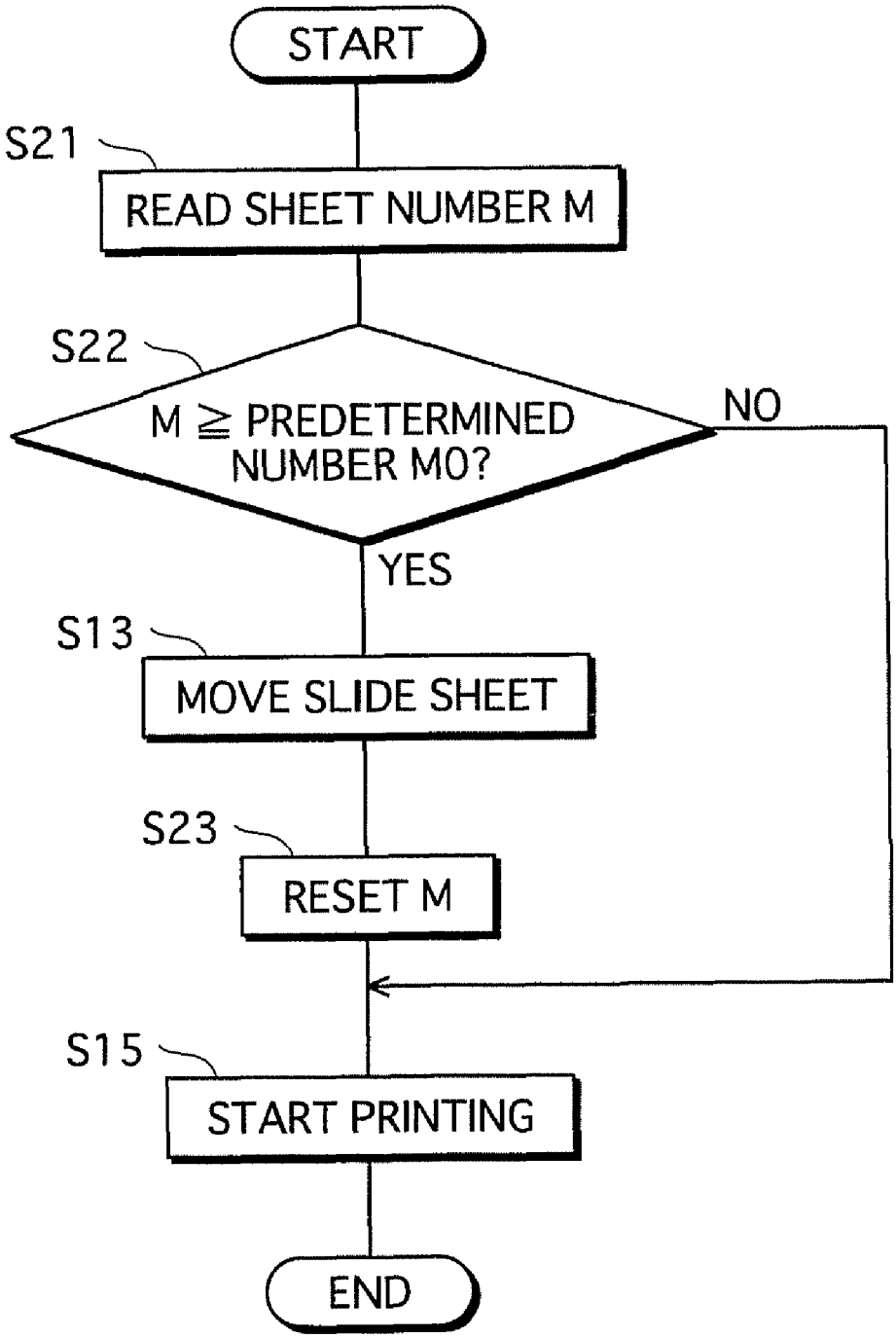
FIG. 6 is a flowchart showing another example of the sheet movement control process.

FIG. 6 is a flowchart showing an example of the sheet movement control process that utilizes the sheet number. Hereinafter, steps that are identical to those shown in FIG. 5 are assigned the same numbers, and therefore descriptions thereof are omitted.

As shown in FIG. 6, the CPU 60 first reads the information indicating the sheet number stored in the sheet number storage 67 (Step S21). The CPU 60 then judges whether or not the read sheet number M is more than or equals to a predetermined number M0 (Step S22). Here, as with the aforementioned T0, the predetermined number M0 is set such that by the time the sheet number M hits or exceeds the predetermined number M0, the slide sheet 53 is assumed to have been worn to the point where problems such as an image shift can occur. For example, the predetermined number M0 can be 10,000 to 20,000.

If judging M≧M0 (the "YES" branch of Step S22), the CPU 60 executes the sheet moving operation (Step S13) and resets the sheet number M (Step S23). On the other hand, if judging M<M0 (the "NO" branch of Step S22), the CPU 60 starts the printing operation without executing the sheet moving operation (Step S15).

The CPU 60 may judge whether or not to execute the sheet moving operation based on both the rotation time and the sheet number.

Figure 7:
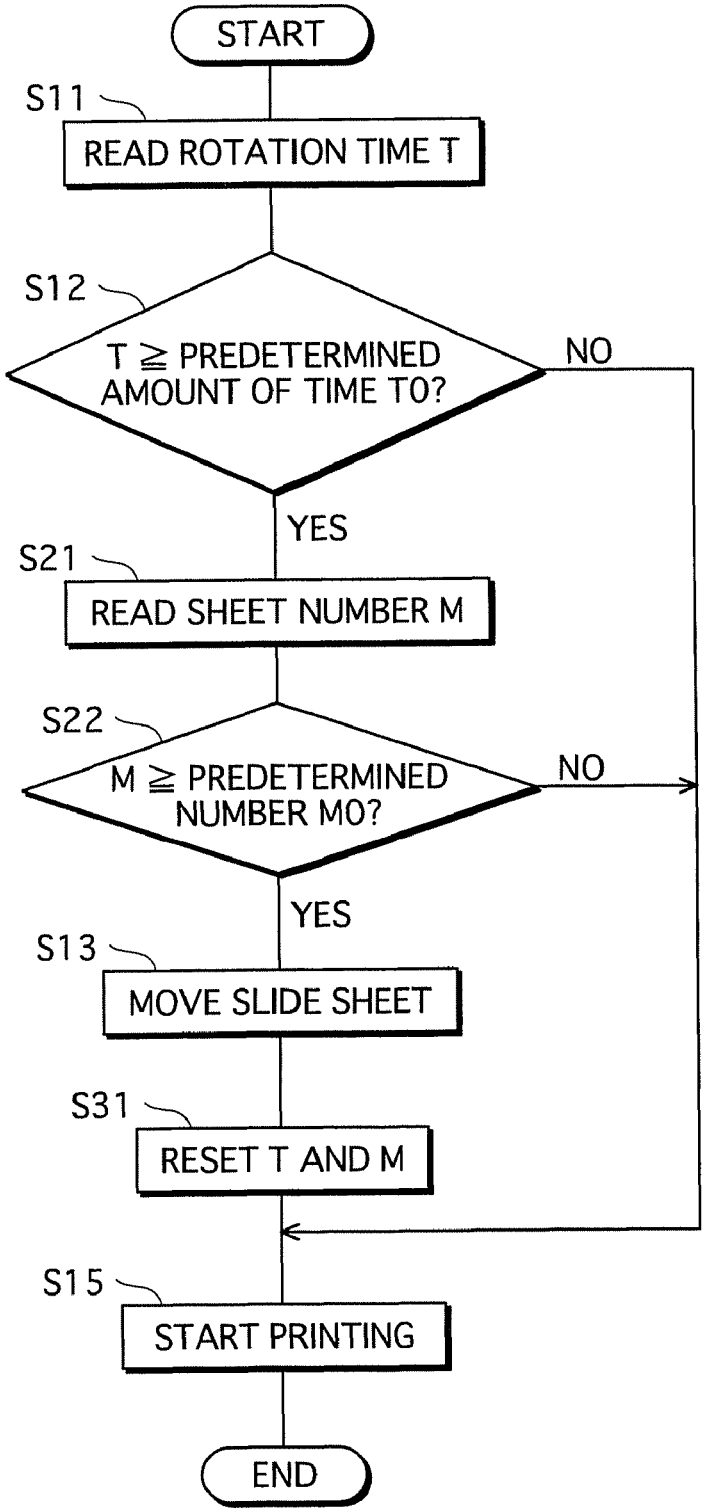
FIG. 7 is a flowchart showing yet another example of the sheet movement control process.

FIG. 7 is a flowchart showing an example of the sheet movement control process that utilizes the rotation time and the sheet number.

As shown in FIG. 7, if judging (i) the rotation time T is more than or equals to the predetermined amount of time T0 (the "YES" branch of Step S12) and (ii) the sheet number is more than or equals to the predetermined number M0 (the "YES" branch of Step S22), the CPU 60 executes the sheet moving operation (Step S13) and resets the rotation time T and the sheet number M (Step S31). On the other hand, if judging T<T0 or M<M0, (the "NO" branches of Steps S12 and S22), the CPU 60 starts the printing operation without executing the sheet moving operation (Step S15).

Although the sheet movement control process precedes the print job according to the above description, it is not limited to such. For example, in the case of executing a print job by feeding a plurality of recording media in succession, the sheet moving operation can be executed between each recording medium—i.e., from the time one recording medium has passed the fixing unit 5 until the next recording medium reaches the fixing unit 5. The sheet moving operation can also be executed while the fixing roller 51 is being rotated during a warm-up period. Preferably, the sheet moving operation should be executed while no recording medium is passing through the fixing unit 5.

The present invention is not limited to a fixing device. Another aspect of the present invention may provide a method for moving a slide sheet provided in the fixing device, or may further be a program that operates the method and that is executed by a computer. The program pertaining to the present invention can be recorded on various types of computer-readable recording media, including: a magnetic disc (e.g., a magnetic tape and a flexible disk); an optical disc (e.g., a DVD-ROM, a DVD-RAM, a CD-ROM, a CD-R, an MO, and a PD); a flash memory and equivalent recording media.

<Exemplary Modifications>

Although the foregoing has described the present invention based on the preferred embodiment thereof, it is not intended to limit the present invention, and therefore many modifications are possible, including the following examples.

(1) According to the above preferred embodiment, the take-up roller 532 is rotated by the take-up motor 533; however, it is not confined to such a structure. For example, the take-up roller 532 may be rotated by the resilience of a coil spring. In this case, the supply roller 531 and the take-up roller 532 are each coupled with a brake mechanism such as an electromagnetic brake. This structure can release the brakes only when the slide sheet 53 is being wound, thus can move the slide sheet 53 only by a predetermined amount. Here, the aforementioned coil spring may not be necessary if the slide sheet 53 is designed to move only by receiving the force, which is generated by friction between the slide sheet 53 and the endless belt 52, toward the direction of the rotation of the endless belt 52.

(2) According to the above preferred embodiment, the slide sheet 53 and the endless belt 52 move in the same direction. However, the direction of their movement is not limited to such. Instead, the slide sheet 53 may move in the reverse direction. If the slide sheet moved in the reverse direction, the supply roller 531 and the take-up roller 532 would trade places with each other. In this situation, along the sheet path 43, the take-up roller, which is a driving side, is positioned upstream of the supply roller. Therefore, the take-up motor and the brake mechanism would be both coupled to the take-up roller. Further, if the slide sheet 53 were moved in the reverse direction, it would be preferable to move the slide sheet 53 while, for example, the endless belt 52 is at rest.

The foregoing has described that only the take-up roller 532 is rotated. The present invention, however, is not confined to such a structure. The present invention may prevent the slide sheet from getting loose in any different manners, as long as the slide sheet 53 can be moved. For example, the supply roller 531 may be rotated a little slower than the take-up roller 532, so that the slide sheet 53 is wound while being pulled in its rotation direction.

(3) The above preferred embodiment has described an exemplary structure in which the take-up roller 532 takes up the slide sheet 53 having the elongated shape. The present invention, however, is not confined to such a structure, as long as it has a support mechanism that can movably support a sheet member that is provided between the endless belt 52 and the pressing member 54 thus reduces friction therebetween. For example, the sheet member may be endless like the endless belt 52. In such a case, the present invention may have the following structure.

A plurality of rollers are provided to an inner side of the endless sheet member (slide sheet), the rollers being rotatably supported, parallel to the aforementioned width-wise direction, by the holders 501 and 502. Also, holes are provided to the sheet member at both ends thereof in the width-wise direction, such that the holes are aligned along the rotation direction of the sheet member. At the same time, a tractor pin, which is engaged with a different one of the holes, is provided to a surface of each roller. One end of each roller penetrates through the holder 502 and is connected to an electromagnetic brake. With this structure, the electromagnetic brake keeps the rollers from rotating until a given condition is satisfied. Since the sheet member is engaged with the tractor pins of the rollers, the sheet member does not move while the electromagnetic brake is placing the rollers at rest. When the given condition is satisfied, the electromagnetic brake is released for a predetermined amount of time. The releasing of the electromagnetic brake restores mobility of the rollers. Accordingly, the sheet member is moved by a predetermined amount by a drive force rotating the endless belt 52. Note that the rollers may be connected to the drive motor, so that the sheet member is moved by a drive force of the drive motor.

(4) As described in the above preferred embodiment, the image forming apparatus pertaining to the present invention is a tandem-type digital color printer. However, the image forming apparatus is not confined to such; it may be a general image forming apparatus having a belt nip type fixing device that fixes unfixed images (e.g., toner images), such as a copier, FAX machine, and MFP (Multiple Function Peripheral). Also, the image forming apparatus should not be limited to a color image forming apparatus but may be an image forming apparatus that forms monochrome images. Further, although the above preferred embodiment has used the pressing member 54 having the soft pad 541 and the hard pad 542, the pressing member 54 is not required to have the soft pad 541 etc. as long as it can ensure an appropriate fixing nip.

According to the above description, the pressing member is pressed by the resilience of the compression spring 544 and the like. However, instead of the compression spring 544, the present invention may incorporate any means that can apply pressure to the pressing member.

The present invention may also incorporate, for example, a means that can apply various degrees of pressure to the pressing member—specifically, the pressing member may be a cam-like pressing member. In this case, the cam-like pressing member is designed to rotate by a predetermined degree so as to apply various degrees of pressure. Here, by controlling the cam-like pressing member to ease the pressure (or apply no pressure) only when the slide sheet 53 is moved, it is possible to reduce friction generated between the endless belt 52 and the pressing member while the slide sheet 53 is being moved. As a result, the slide sheet 53 moves more smoothly. The slide sheet 53 may also be moved in the opposite direction from the endless belt 52.

The present invention can be realized by any combination of the above preferred embodiment and exemplary modifications.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be constructed as being included therein.

What is claimed is:

1. A fixing device that forms, with use of an endless belt and a fixing roller that are positioned facing each other, a fixing nip by placing the endless belt in contact with the fixing roller while causing a pressing member to press the endless belt from an inner side thereof against the fixing roller, and that fixes an unfixed image onto a recording medium when the recording medium passes through the fixing nip, the fixing device comprising:

a sheet member that is provided between the endless belt and the pressing member and thus reduces friction therebetween;

a supporting mechanism that movably supports the sheet member; and a sheet member moving part that, when a predetermined condition is not satisfied, keeps the sheet member at rest, and when the predetermined condition is satisfied, moves the sheet member in a certain direction by a predetermined amount.

2. The fixing device of claim 1, wherein the sheet member has an elongated shape, and the supporting mechanism is a take-up mechanism that includes (i) a supply roller on which the sheet member has been wound and (ii) a take-up roller that takes up the sheet member from the supply roller by winding the sheet member thereon.

3. The fixing device of claim 2, wherein along a recording medium transport direction, the supply roller is disposed upstream of the fixing nip, whereas the take-up roller is disposed downstream of the fixing nip, and when the predetermined condition is not satisfied, the sheet member moving part keeps the sheet member at rest by applying a brake to the supply roller, and, when the predetermined condition is satisfied, the sheet member moving part releases the brake and causes the take-up roller to take up the sheet member by winding the sheet member thereon.

4. The fixing device of claim 3, wherein the certain direction is a direction in which the endless belt rotates at the fixing nip, and the sheet member moving part causes the take-up roller to take up the sheet member by winding the sheet member thereon while the endless belt is rotating.

5. The fixing device of claim 1, wherein the predetermined condition is satisfied when a total amount of time elapsed since a start of a rotation of the endless belt hits or exceeds a predetermined amount of time.

6. The fixing device of claim 1, wherein the predetermined condition is satisfied when a total number of the recording medium that has passed through the fixing nip hits or exceeds a predetermined number.

7. The fixing device of claim 1, wherein the predetermined amount corresponds to a length of the fixing nip in a recording medium transport direction.

8. The fixing device of claim 1, wherein the sheet member moving part moves the sheet member when the recording medium to be transported is not passing through the fixing nip.

9. An image forming apparatus comprising:

the fixing device of claim 1 as a fixing part that fixes an unfixed image that have been formed on a recording medium to be transported.

* * * * *